US005141167A

United States Patent [19]

Stelk

[11] Patent Number: 5,141,167

[45] Date of Patent: Aug. 25, 1992

[54] HEAVY DUTY DISC-SPIDER ASSEMBLY FOR A HAMMERMILL

[75] Inventor: John C. Stelk, Bettendorf, Iowa

[73] Assignee: Slvyer Steel Corporation, Bettendorf, Iowa

[21] Appl. No.: 705,740

[22] Filed: May 28, 1991

[51] Int. Cl.[5] ..... B02C 13/00

[52] U.S. Cl. ..... 241/194; 241/197

[58] Field of Search ..... 241/194, 197, 191, 195

[56] References Cited

U.S. PATENT DOCUMENTS 3,627,212 12/1971 Stanton ..... 241/194 X 3,727,848 4/1973 Francis ..... 241/197 X

*Primary Examiner*—Dougles D. Watts

*Attorney, Agent, or Firm*—Foley & Lardner

[57] ABSTRACT

A hammer assembly for a hammermill of the type having a housing forming a fragmentizing chamber, a hammermill assembly being mounted for rotary motion in the chamber and including a drive shaft, a number of spider assemblies axially aligned on the shaft, each spider assembly including a number of arms having a pin opening at the outer end thereof, a number of discs alternately arranged on the shaft between the spider assemblies, each disc including a number of hammer pin openings corresponding to the number of openings in the spider arms to form axially aligned rows of openings, a hammer pin aligned at each row of openings and a number of hammers randomly mounted on the hammer pins in the spaces provided in the spider arms and between the adjacent discs.

7 Claims, 2 Drawing Sheets

HEAVY DUTY DISC-SPIDER ASSEMBLY FOR A HAMMERMILL

FIELD OF THE INVENTION

This invention generally relates to a heavy duty hammermill and more particularly to a hammer assembly having alternately arranged spider arms and discs with hammers mounted for rotary motion in the spaces provided by the spider arms between the discs to break up heavy metal scrap.

BACKGROUND OF THE INVENTION

Hammermills of the type contemplated herein are widely used to reduce metal objects, such as cars, into small metal fragments by the rotation of a hammer assembly within the housing of the hammermill. A hammermill of this general type is shown in U. S. patent application Ser. No. 07/554,139, filed on Jul. 16, 1990, entitled, "Heavy Duty Spider Assembly For A Hammermill," and assigned to the same assignee. The assembly disclosed in this application is formed by a number of six arm spiders which are axially aligned on the hammermill shaft for rotation within the hammermill housing. A number of hammers are randomly mounted on the various spider arms which are spaced apart by spacers located on the hammermill shaft.

The hammermill as described above is used to shred heavy metal scrap, commonly denominated No. 2 scrap. The spider arms are spaced apart around a hub portion with the hammers located in the spaces between the spider arms. End caps are provided on the ends of the spider arms for absorbing the impact of shredded pieces with the outer ends of the spider arms to thereby extend the life of the spiders.

In U.S. Pat. No. 4,613,088, issued on Sep. 23, 1986, and entitled, "Arrangement For Reinforcing And Spacing Annular Disks Of A Hammer Rotor," a hammermill is disclosed wherein the discs are equally spaced along the hammermill drive shaft with the hammers mounted between the discs on hammer pins at various positions within the hammer assembly. The edges of the discs are covered by replaceable strips which provide a shield to protect the outer periphery of the discs and thereby prevent wear due to impact with the heavy metal scrap. In this type of a hammermill the hammers rotate through openings in the shield, thus providing impact only on engagement of the hammers with the heavy metal scrap. However, loose pieces of scrap can be pulled into the hammer assembly and retained therein by the shield.

SUMMARY OF THE PRESENT INVENTION

The heavy duty hammer assembly of the present invention is designed for use in fragmenting No. 2 scrap metal using the same basic dimensions of the hammermills as described above. The hammer assembly generally includes a number of three arm spiders mounted on a drive shaft. A number of discs are alternately arranged on the drive shaft between the spiders with an end disc located at each end of the hammer assembly. A number of hammers are mounted for rotation in the spaces between the discs on hammer pins in the hammer assembly. The size of metal scrap impacted by the spider arms is thereby limited to the space between the discs. Although hammers could be provided in all of the spaces provided between the discs in the hammer assembly normally there are only ten to fourteen hammers provided in the hammer assembly.

One of the primary advantages of this arrangement is the ability to reduce heavy metal objects while minimizing the size of material which impacts the spider arms.

The hammer assembly is also provided with protective end caps mounted on the ends of the spider arms which project outwardly from the end of the discs thereby advantageously providing both protection for the ends of the spider arms as well as a secondary impact surface for engaging the metal objects.

Other principal features and advantages of the invention will become apparent to those skilled in the art upon review of the following drawings, the detailed description and the appended claims.

DETAILED DESCRIPTION OF THE DRAWINGS

Figure 1:
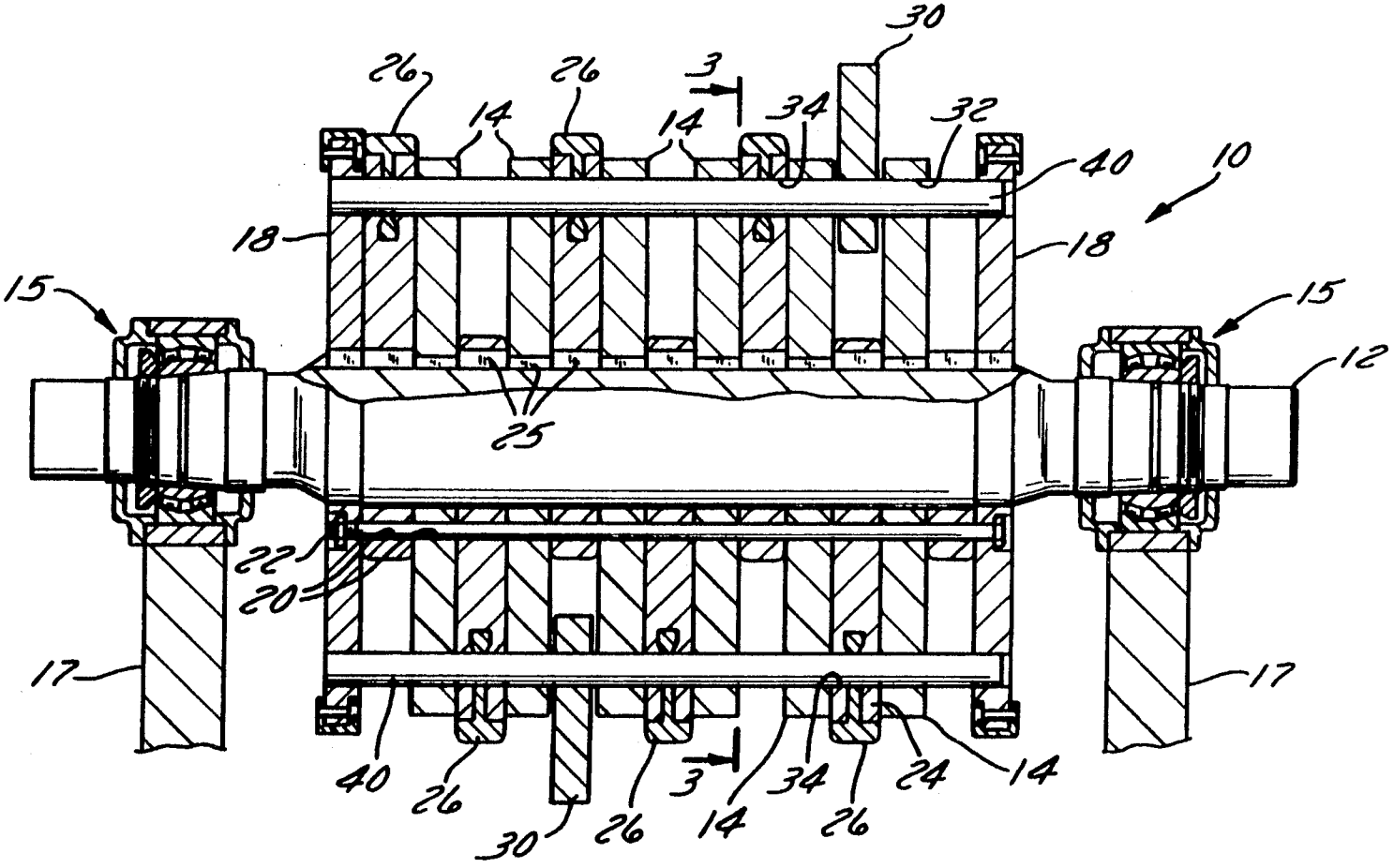
FIG. 1 is a longitudinal cross-sectional view of the hammer assembly according to the invention.
Figure 2:
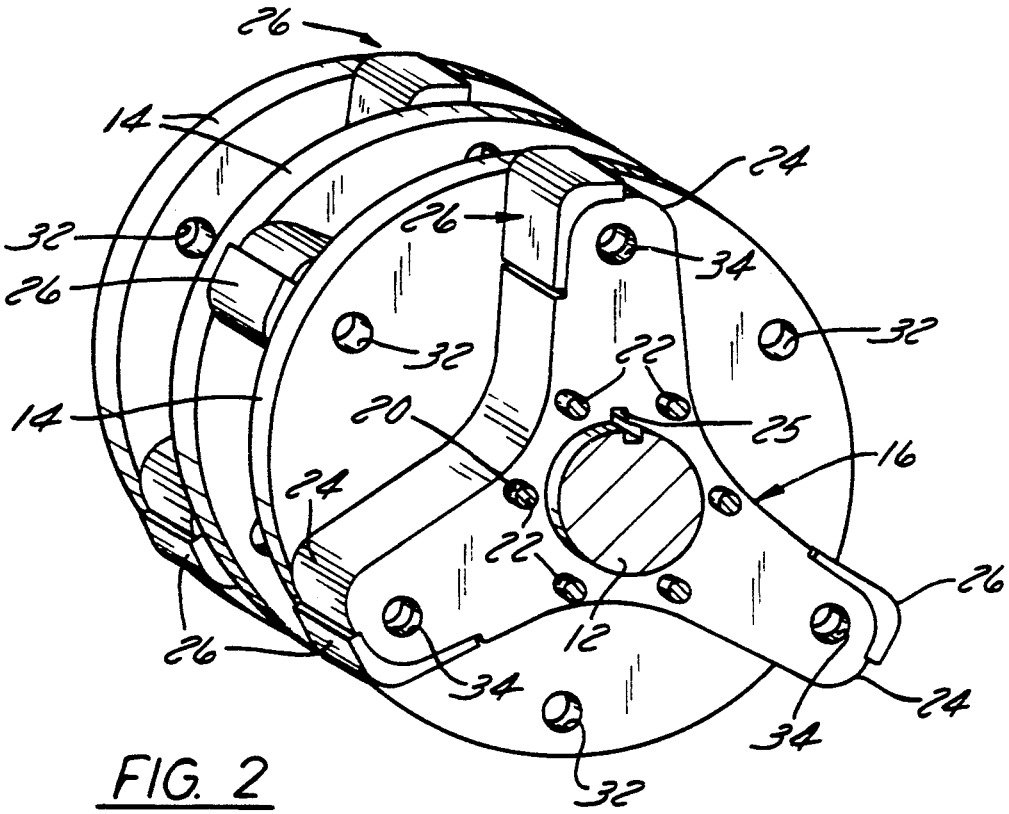
FIG. 2 is a perspective view of a portion of the hammer assembly.
Figure 3:
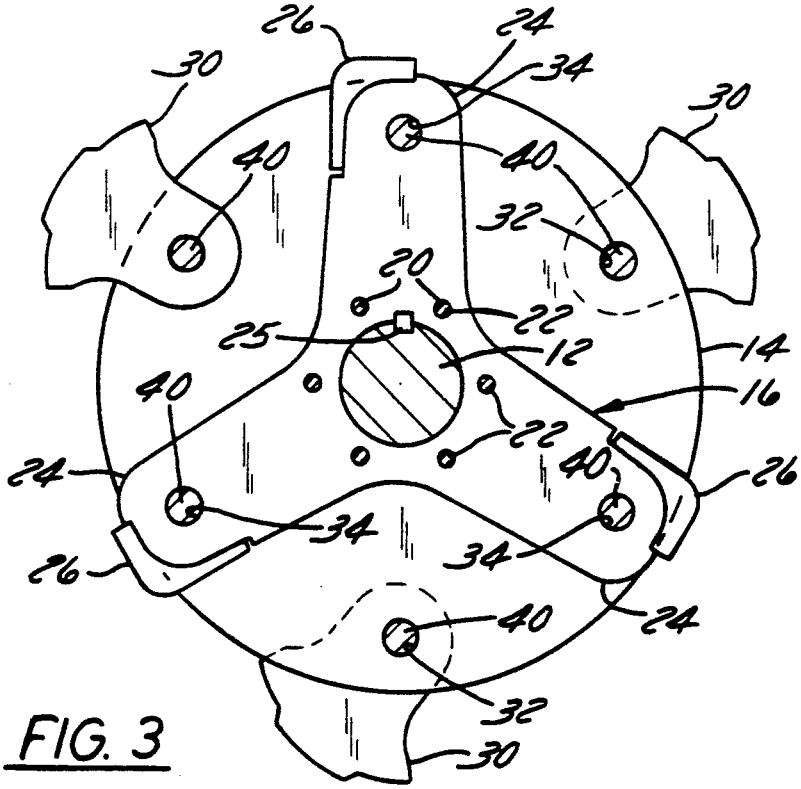
FIG. 3 is a view taken on line 3—3 of FIG. 1.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

The hammer assembly 10 according to the present invention is of the type used in a hammermill as described in U.S. patent application Ser. No. 07/554,139, filed on Jul. 16, 1990, the disclosure of which is incorporated herein by reference. This type of hammermill generally includes a fragmentizing chamber in which metal objects and the like, are broken up into small metal fragments.

Referring to the drawings in detail, the hammer assembly as shown in the Figures, includes a rotor shaft 12 which is shown mounted for rotation in shaft bearing assemblies 15 provided in the side plates 17 of a hammermill. A number of discs 14 and a number of spider assemblies 16 are alternately arranged along the length of the shaft 12 An end disc 18 is provided on each end of the shaft 12. The discs 14, 18 and spiders 16 are secured to the drive shaft 12 by means of keys 25. It should be noted that the discs 14, 18 and spider assemblies 16 each include a number of holes or openings 20 arranged in a circle around the axis of the shaft 12 at equally spaced intervals. The discs 14, 18 and spiders 16 are secured together by means of tie rods 22 aligned in the openings 20.

The spider assemblies 16 each have three arms 24, the ends of which are protected from impact by protective caps 26. The spider assemblies 16 are alternately arranged on the shaft 12 between the discs 14. It should be noted that the spider assemblies 16 are also alternately arranged with respect to each other. A space is thereby provided for the hammer 30 between two of the spider arms 24 and the adjacent discs 14. Although the spider assemblies 16 and discs 14 and 18 are arranged as described above, two spider assemblies 16 could be aligned to provide a space for hammers 30 on each side of one of the discs 14.

It should be noted that the diameter of the discs 14, 18 is substantially equal to the diameter of the spider arms 24. The space between the discs 14 and 18 therefore defines the size of metal object which can enter the space between the arms 24 of spiders 16 and thereby limit the size of metal objects impacted by the arms 24. The end caps 26 project outwardly from the discs 14 to provide a secondary impact surface for engaging the metal fragments.

The hammers 30 are randomly provided on the hammer assembly for impacting the heavy metal objects. In this regard each of the discs 14 and 18 are provided with a number of hammer pin openings 32 arranged at equal distances from both the axis of the main shaft 12 and each other. Corresponding openings 34 are provided on the ends of the spider arms 24 which are aligned with the openings 32 in the discs. Hammer pins 40 are mounted in each row of holes 32, 34 in the discs 14, 18 and arms 24, respectively. The hammers 30 are mounted on the hammer shafts 40 in the spaces between the spider arms 24. The hammers 30 are free to rotate in the spaces between the spider arms 24 and the discs 14, 18.

In operation, the free swinging hammers 30 rotate with respect to the hammer pins 40 into engagement with the metal objects in the hammermill. The material entering the hammermill is initially broken up by the swinging motion of the hammers 30. As the material is broken up it will impact the end caps 26. Small fragments may enter the space between the discs and impact the surface of the end caps in the face of the spider arms 24.

Thus, it should be apparent that there has been provided in accordance with the present invention a heavy duty disc-spider assembly for a hammermill that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A spider disc assembly for a rotary hammermill comprising:

a shaft, a number of three arm spider assemblies and discs alternately arranged on said shaft, said three arm spider assemblies being angularly offset from the next adjacent spider assembly, a number of rows of openings in said spider assemblies and said discs, a hammer pin mounted in each row of holes, and a number of hammers randomly mounted on said hammer pins in the spaces provided in said spider assemblies and between said discs.

2. The assembly according to claim 1 wherein said spiders each included a protective cap mounted on the outer end of each of said spider arms.

3. The assembly according to claim 2 wherein the diameter of said spider arms and said discs are substantially equal and said protective caps project outwardly from said spider arms beyond the outer edge of said discs.

4. A hammer assembly for a heavy duty hammermill, said assembly comprising:

a drive shaft, a plurality of discs mounted on said shaft, a plurality of spider assemblies mounted on said shaft, each of said spider assemblies includes one or more spider arms having a radius substantially equal to the radius of said discs and a protective cap mounted on the end of each spider arm and projecting outwardly from said discs, said spiders being alternately arranged with said discs, a number of hammer shafts extending through said spiders and discs at equally spaced intervals, and a number of hammers mounted on said shafts between said discs for rotation in the spaces defined by said spider assemblies between said discs.

5. A hammer assembly for a hammermill of the type having a housing forming a fragmentizing chamber, said hammer assembly being mounted for rotary motion in the fragmentizing chamber, and comprising:

a drive shaft, a number of spider assemblies axially aligned on said shaft, each spider assembly including three equally spaced arms having a hammer pin opening at the outer end thereof, each alternate spider arm being offset from the adjacent spider arms, a number of discs alternately arranged on said shaft between said spider assemblies, said discs and spiders forming alternately offset spaces around the periphery of said assembly, each disc including a number of hammer pin openings corresponding to the openings in said spider arms to form axially aligned rows of openings, a hammer pin aligned in each row of openings, and a number of hammers randomly mounted on said hammer pins in the spaces provided between the spider arms and said adjacent discs.

6. The hammer assembly according to claim 5 wherein said discs have a diameter substantially equal to the diameter of said spider arms.

7. The hammer assembly according to claim 6 including a removable protective cap mounted on the end of each of said spider arms and extending outwardly beyond said discs.

* * * * *